US010343027B2

(12) United States Patent
Ou

(10) Patent No.: US 10,343,027 B2
(45) Date of Patent: Jul. 9, 2019

(54) SPORTSBALL AND MANUFACTURING METHOD THEREOF

(71) Applicant: Tsung Ming Ou, Kaohsiung (TW)

(72) Inventor: Tsung Ming Ou, Kaohsiung (TW)

( * ) Notice: Subject to any disclaimer, the term of this patent is extended or adjusted under 35 U.S.C. 154(b) by 0 days.

(21) Appl. No.: 15/791,360

(22) Filed: Oct. 23, 2017

(65) Prior Publication Data

US 2019/0118043 A1 Apr. 25, 2019

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01); *A63B 2209/00* (2013.01)

(58) Field of Classification Search
CPC ..... A63B 41/08; A63B 45/00; A63B 2209/00; A63B 41/10
USPC ..... 473/603–605
See application file for complete search history.

(56) References Cited

U.S. PATENT DOCUMENTS 1,890,566 A * 12/1932 Bartky ..... A63B 41/08 473/599
2,172,425 A * 9/1939 Webb ..... B29D 22/02 473/610
4,169,594 A * 10/1979 Crane ..... A63B 41/10 473/604
4,498,667 A * 2/1985 Tomar ..... A63B 37/06 273/DIG. 11
D405,486 S * 2/1999 Chan ..... D21/713
D408,877 S * 4/1999 Sonntag ..... D21/713
D416,961 S * 11/1999 Sonntag ..... D21/713
D473,275 S * 4/2003 Gundra ..... D21/713
6,988,969 B2 * 1/2006 Avis ..... A63B 41/08 473/599
7,862,458 B2 * 1/2011 Avis ..... A63B 41/08 473/604
8,133,139 B2 * 3/2012 Avis ..... A63B 41/08 473/604
8,602,927 B2 * 12/2013 Marc ..... B29D 22/04 473/605
2005/0153803 A1 * 7/2005 Swiszcz ..... A63B 41/08 473/593

(Continued)

*Primary Examiner* — Steven B Wong
(74) *Attorney, Agent, or Firm* — Raymond Y. Chan; David and Raymond Patent Firm

(57) ABSTRACT

A sportsball and manufacturing method thereof are provided. The sportsball includes a carcass and a ball cover. The ball cover includes two or more cover panels having connecting sides connected with each other in edge to edge manner to form a plurality of connecting seams. The ball cover is supported and retained by the construction layer of the carcass in a desired roundness after air inflation. At least one the cover panels of the ball cover provides one or more virtual stitching seams molded to form thereon each imitating an actual stitching seam but having no stitching hole and gap. Each of the virtual stitching seams has a virtual seam recess and a plurality of virtual stitching marks along a bottom of the virtual seam recess imitating actual stitching marks of stitching thread like the actual stitching seam after sides of panels being sewn edge to edge together, so as to reduce the number of cover panels of the ball cover and minimize the presence of stitching holes and gaps of the ball cover.

22 Claims, 13 Drawing Sheets

(56) References Cited

U.S. PATENT DOCUMENTS

| | | | | |
|---|---|---|---|---|
| 2006/0199684 | A1* | 9/2006 | Kelly | A63B 41/08 473/599 |
| 2006/0229150 | A1* | 10/2006 | Ou | A63B 41/08 473/604 |
| 2009/0011878 | A1* | 1/2009 | Ou | A63B 41/08 473/605 |
| 2009/0325742 | A1* | 12/2009 | Krysiak | A63B 41/08 473/596 |
| 2011/0015011 | A1* | 1/2011 | Chou | A63B 41/00 473/605 |
| 2011/0165979 | A1* | 7/2011 | Cohen | A63B 41/08 473/605 |

* cited by examiner

SPORTSBALL AND MANUFACTURING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to sportsball, and more particularly to a sportsball with virtual stitching seams between cover panels thereof and manufacturing method thereof.

Description of Related Arts

In the sports games, such as basketball, volleyball and soccer ball games, a fair game replies not only rules and players' sportsmanship, the objects used in games are kind of significant and controllable as hardware. It is hard to balance geometric principles between application situations. The roundness of a sportsball is a main concern of all sportsball players.

It is well known that the sportsball, especially soccer ball and volleyball, has a better quality with less pieces of cover panels thereon. Since the sportsball cannot be made in only one round cover panel, multiple cover panels with different shapes are connected in an edge to edge manner to form a ball cover to enclose the ball carcass to form sportsball.

Sportsball, such as soccer ball and volleyball, as shown in FIGS. 1 and 2, generally comprises a ball cover 11 and a bladder ball 12 disposed within the ball cover 11. The ball cover 11 is made of leather or synthetic leather such as polyurethane (PU) or polyvinyl chloride (PVC). As shown in FIG. 2, the synthetic leather is composed of an outer coating layer 111, an intermediate foaming layer 112 and an inner lining layer 113 to strengthen and support the foaming layer 112. The bladder 12 is a spherical rubber ball having a valve stem 121 affixed thereon.

The leather or synthetic leather is cut into a plurality of panels 110 with predetermined shape. For soccer ball, the most common shape of the panel 110 is pentagon and hexagon. In other words, the ball cover 11 of a soccer ball is made of 12 pieces of pentagonal panels and 20 pieces of hexagonal panels by hand sewing edge to edge. The spherical ball cover 11 of a volleyball consists of 18 pieces of rectangular panels hand sewn edge to edge. The inflatable bladder ball 12 is placed inside the ball cover 11 and its valve stem 121 is extended outside the ball cover 11 for air inflation. When air is pumped into the bladder ball 12 through the valve stem 121, the air inflates the bladder ball 12 to prop up the ball cover 11 and retain its roundness. Therefore, an inflated sportsball has a bouncing feature. The more air is inflated into the bladder ball 12, the sportsball has a better bounce.

The rigidity and durability of a conventional sportsball as described above merely depend on the structure of the ball cover 11 but not the soft rubber bladder ball 12. The structure of the ball cover 11 must be tough enough to absorb all the impact forces. Therefore, the panels 110, either made of leather or synthetic leather, must be further strengthened by affixing at least two more layers of coarse lining 114, 115 thereon in order to better support the ball cover 11 and resist the stress. The roundness and reinforcement of the sportsball depend on the strength of the lining cloth. Hence, the material used for the lining cloth is very important that, it may increase the material cost of the conventional sportsball. Basically, the additional linings 114, 115 are glued layer by layer on the inner lining layer 113 of the synthetic leather or the inner side of the leather before cutting into the panels 110, which increases a manufacturing adhesion step for the conventional sportsball.

To hand sewing leather panels edge to edge with each other as shown in FIG. 2 is really a hard and quality work that requires skillful and experienced workers to accomplish. In addition, the additional coarse linings not only increase the thickness of the ball cover 11, but also increase the hardness of the ball cover 11. Thus, the thick and hard panels 110 increase the difficulty of sewing the panels together by sewing machines, especially during sewing around the sharp corners of the panels 110, that is the weakest portion of the ball cover 10. It is the reason that why most of the formal or classic sportsballs are still hand made. The workers have to sew the panels 110 together one by one by hand. It is extremely uneconomic and time consuming that would highly increase the manufacturing cost of the sportsballs.

Another serious shortcoming of the hand sewing sportsball is that it is nearly impossible to evenly sew the panels together under same tightness. Therefore, when the sportsball is inflated, the ball cover 11 would be propped by the inflated bladder ball 12 to protrude outwardly at some less tightly constructed portions, so that the roundness of the sportsball is adversely affected. Moreover, the sewing threads 116 may more easily be broken during heavy impact, so that thickened sewing threads 116 should be used. In fact, no handmade sportsball is in absolutely spherical shape, that may affect the performance of the conventional sportsball. When the sportsball is hit on such protruded portion, it may not bounce to the desired direction. Besides, those weaker portions of the sportsball will more easily be worn out and those sewing threads at such portions may also more easily be broken.

Since the linings 114, 115 are made of cloth, they tend to stretch while the sportsball is hit. At that time, the sportsball would lose its spherical shape because of the lining stretching. Practically, the inflated bladder ball 12 is directly propped on the additional linings 114, 115, therefore the major stress supporting area of the sportsball is the connecting surface between the additional linings 114, 115 and the leather or synthetic leather of the ball cover 11. It is well known that the stress resisting ability and the durability of cloth material are poor. In other words, the additional linings 114, 115 are not strong enough to endure those inflating stress and impact stress, especially during the impacting of the sportsball. The additional linings 114, 115 will rip apart sooner or later that would cause the sportsball to be worn off and damaged.

Furthermore, the leather or the thickened and hardened synthetic leather ball cover 11 of the conventional soccer ball may make the soccer player feels hurt and pain during heading, especially to children and those training players. The volleyball which is constructed by such conventional ball cover 11 may also cause the volleyball player feels pain and uncomfortable during servicing, spiking and blocking.

For children and training soccer players or volleyball players, such thickened and hardened ball cover 11 of the conventional sportsball would be too rigid and hard for them.

Another problem is aesthetic pattern printed on the cover panels 110 is the influence by the recessed stitching seams 120. Also, there is a kind of aesthetic pattern formed across several pieces of the cover panels 110 which is difficult to align with adjacent cover panels 110 without high accuracy. It is worth to mention that the pattern is drawn on each of the cover panels 110 in advanced. To print aesthetic pattern directly on the spherical geometry needs high cost technology and equipment which is hardly to be popular for the market. Also, the cover panels 110 with different pattern are differ to each other, which causes an extra step to classify the cover panels 110 before sewing.

To reduce the amount of the cover panels 110 is the key to improve the performance of the sportsball. The well-known soccer ball, named as Teamgeist, made of 14 pieces of the cover panels 110. The Jabulani comprises 8 pieces of the cover panels 110. The Brazuca comprises 6 pieces of the cover panels 110. But the conventional method is to design special shape of each of the cover panels 110. It is conventional that the traditional sportsball is in non-regular polygons to give a closer approximation to sphericality. But the design of the cover panels 110 is limited by the spherical geometry, and the technology to sewing the cover panels 110 needs to follow the design while the path of sewing is not straight along diameter. And the non-regular polygons of the cover panels 110 are in different shape between planar state and stereoscopic state that needs additional technique to sustain the cover panels 110 when covering the bladder 12. For production, the non-regular polygons of the cover panels 110 rises the difficulty and the cost of manufacturing.

SUMMARY OF THE PRESENT INVENTION

The invention is advantageous in that it provides a sportsball and manufacturing method thereof, wherein the amount of cover panels to cover a bladder ball is reduced and controllable to form spherical ball shape with desired roundness.

Another advantage of the invention is to provide a sportsball and manufacturing method thereof, wherein the number of the connecting sides of the cover panels to be sewn with each other to form the ball cover to receive the ball carcass therein can be minimized so as to facilitate the manufacturing process and reduce manufacturing cost.

Another advantage of the invention is to provide a sportsball and manufacturing method thereof, wherein each of the cover panels is molded to form one or more virtual stitching seams imitating the actual recessed stitching seams formed between the sewn connecting sides of the cover panels so as to form multiple imitating panels.

Another advantage of the invention is to provide a sportsball and manufacturing method thereof, wherein the ball cover of the sportsball is constructed by two or more cover panels connected in edge to edge manner to form one or more connecting seams between the cover panels. In one embodiment, the cover panels are adhered on the ball carcass of the sportsball and the connecting seams between the cover panels are molded to form virtual recessed stitching seams imitating the actual stitching seams respectively.

Another advantage of the invention is to provide a sportsball and manufacturing method thereof, wherein the ball cover of the sportsball is constructed by sewing the connecting sides of two or more cover panels in edge to edge manner to form one or more connecting seams which are actual stitching seams between the cover panels, wherein one or more virtual stitching seams are molded on each of the cover panels, imitating the actual stitching seams, sewn between connecting sides of the cover panels so as to form multiple imitating panels.

Another advantage of the invention is to provide a sportsball and manufacturing method thereof, wherein each of the cover panels is able to be shaped to reduce the number of cover panels and the total length of the actual stitching seams to form the ball cover for receiving the ball carcass of the invention therein to form the sportsball.

Another advantage of the invention is to provide a sportsball and manufacturing method thereof, wherein multiple imitating panels are formed in predetermined shape or in regular polygon shape by the virtual stitching seams such that the number of cover panels to form the ball cover can be reduced to provide better performance of the sportsball.

Another advantage of the invention is to provide a sportsball and manufacturing method thereof, wherein less stitching holes and gaps are formed in the ball cover that helps for better motion in air.

Another advantage of the invention is to provide a sportsball and manufacturing method thereof, wherein no stitching hole or gap is formed in the cover panels of the ball cover that helps for better motion in air.

Another advantage of the invention is to provide a sportsball and manufacturing method thereof, wherein predetermined aesthetic pattern can be printed on the cover panels, before sewing together to form the ball cover, wherein the stitching seams thereon are virtual stitching seams molded on the cover panels after the aesthetic pattern is printed thereon. Accordingly, it can avoid the misalignment of the aesthetic pattern at the stitching seams between the panels and more complicate and colorful aesthetic pattern can be designed to print on the ball cover.

Another advantage of the invention is to provide a sportsball and manufacturing method thereof, wherein predetermined aesthetic pattern can be printed across the virtual stitching seams of the cover panel.

Another advantage of the invention is to provide a sportsball and manufacturing method thereof, wherein the virtual stitching seams are molded under a predetermined pressure to form a seam recess on the cover panel to imitate the actual seam recess of the actual stitching seam sewn between the cover panels.

Additional advantages and features of the invention will become apparent from the description which follows, and may be realized by means of the instrumentalities and combinations particular point out in the appended claims.

According to the present invention, the foregoing and other objects and advantages are attained by a sportsball, comprising:

a carcass comprising an inflatable bladder ball, a valve stem mounted on the bladder ball, and an exterior construction layer covering the bladder ball to reinforce and strengthen the bladder ball to support stress and impact force; and a ball cover having a valve hole where the valve stem extended thereat for air inflation, wherein the ball cover comprises two or more cover panels having connecting sides connected with each other in edge to edge manner to form a plurality of connecting seams, wherein the ball cover is supported and retained by the construction layer in a desired roundness after air inflation, wherein at least one the cover panels of the ball cover further provides one or more virtual stitching seams molded to form thereon, each of which is adapted for imitating an actual stitching seam but having no stitching hole and gap, wherein each of the virtual stitching seams has a virtual seam recess and a plurality of virtual stitching marks formed along a bottom of the virtual seam recess for imitating actual stitching marks of stitching threads like the actual stitching seam after sides of panels being sewn edge to edge together.

In one embodiment, the construction layer is a construction web layer integrally provided on an outer surface of the bladder ball such that the bladder ball is entirely embraced by the construction web layer.

In one embodiment, the construction layer is a construction ball pocket receiving the bladder ball therein such that the bladder ball is inflated with a predetermined amount of compression air for retaining the shape of the construction ball pocket.

In one embodiment, the virtual stitching seams are molded by heat pressing by moulds.

In one embodiment, the connecting sides of the two or more cover panels are sewn together by stitching threads in edge to edge manner to form a plurality of actual recessed stitching seams, wherein the virtual stitching seams are molded to look like the actual recessed stitching seams that each of the actual recessed stitching seams has an actual seam recess and a plurality of actual stitching marks.

In one embodiment, the cover panels are adhered on the construction layer of the ball carcass to form the ball cover enclosing the ball carcass, wherein connecting edges between the cover panels form the connecting seams and are molded to form the virtual stitching seams each having the virtual seam recess and the virtual stitching marks.

According to the present invention, the foregoing and other objects and advantages are also attained by a manufacturing method of the sportsball, which comprises the steps of:

(a) Prepare the two or more cover panels, each having the connecting sides, wherein the ball carcass comprises an inflatable bladder ball, a valve stem mounted on the bladder ball, and an exterior construction layer covering the bladder ball to reinforce and strengthen the bladder ball to support stress and impact force.

(b) Form the plurality of virtual stitching seams on each of the cover panels, wherein each of the virtual stitching seams has the seam recess and the plurality of virtual stitching marks imitating the actual recessed stitching seam.

(c) Connect the connecting sides of the cover panels in edge to edge manner forming a plurality of connecting seams to form a ball cover having a ball shape, a valve hole and a receiving cavity therein, wherein the ball carcass is disposed in the ball cover while the valve stem is extended at the valve hole of the ball cover for air inflation, wherein the ball cover is supported and retained by the construction layer in a desired roundness after air inflation in the ball carcass.

In one embodiment, the step (c) further comprises a step of sewing the connecting sides together to form the plurality of actual recessed stitching seams, each having the actual seam recess and the plurality of actual stitching marks, wherein the virtual stitching seams on the cover panels are molded to look like the actual recessed stitching seams, each having the virtual seam recess and the plurality of virtual stitching marks.

In one embodiment, the step (c) further comprises a step of adhering the cover panels on the construction layer of the ball carcass to form the ball cover enclosing the ball carcass, and the method further comprises a step of forming virtual stitching seams at the connecting seams between the connecting cover panels respectively by molding, wherein each of the virtual stitching seams are molded to also have a seam recess and stitching marks to look like the virtual stitching seams molded on the cover panels.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
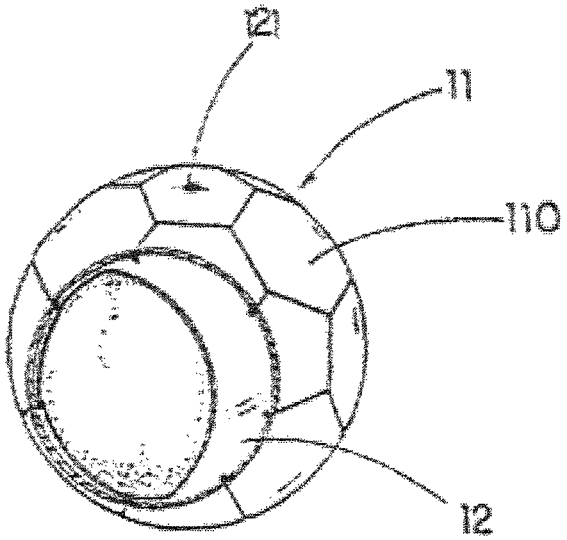
FIG. 1 PRIOR ART
FIG. 1 is an exploded perspective view of a traditional sportsball, which is illustrated as a soccer ball.
Figure 2:
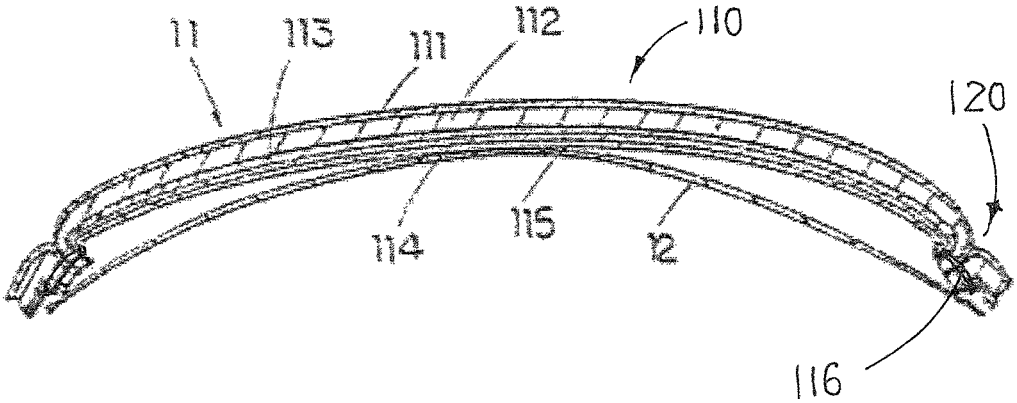
FIG. 2 PRIOR ART
FIG. 2 is a sectional view of a sportsball of a traditional sportsball, illustrating the actual stitching seams of the panels sewn edge to edge together to enclose the bladder ball therein.

Referring to FIGS. 3A to 7, a sportsball 20 according to a preferred embodiment of the present invention is illustrated, the sportsball 20, such as soccer ball, volleyball or handball, comprises a ball cover 30 having a valve hole 301 formed thereon and a receiving cavity 302 provided therein, and a ball carcass 40 received in the receiving cavity 302 of the ball cover 30. The ball carcass 40 comprises an inflatable bladder ball 41 which has a valve stem 411 mounted thereon, constructed as the conventional bladder ball 12 and valve stem 121 as shown in FIGS. 1 and 2. The ball carcass 40 according to the preferred embodiment of the present invention further comprises an exterior construction layer 43 covering the bladder ball 41 to reinforce and strengthen the bladder ball 41 to support stress and impact force of the sportsball 20.

Figure 3A:
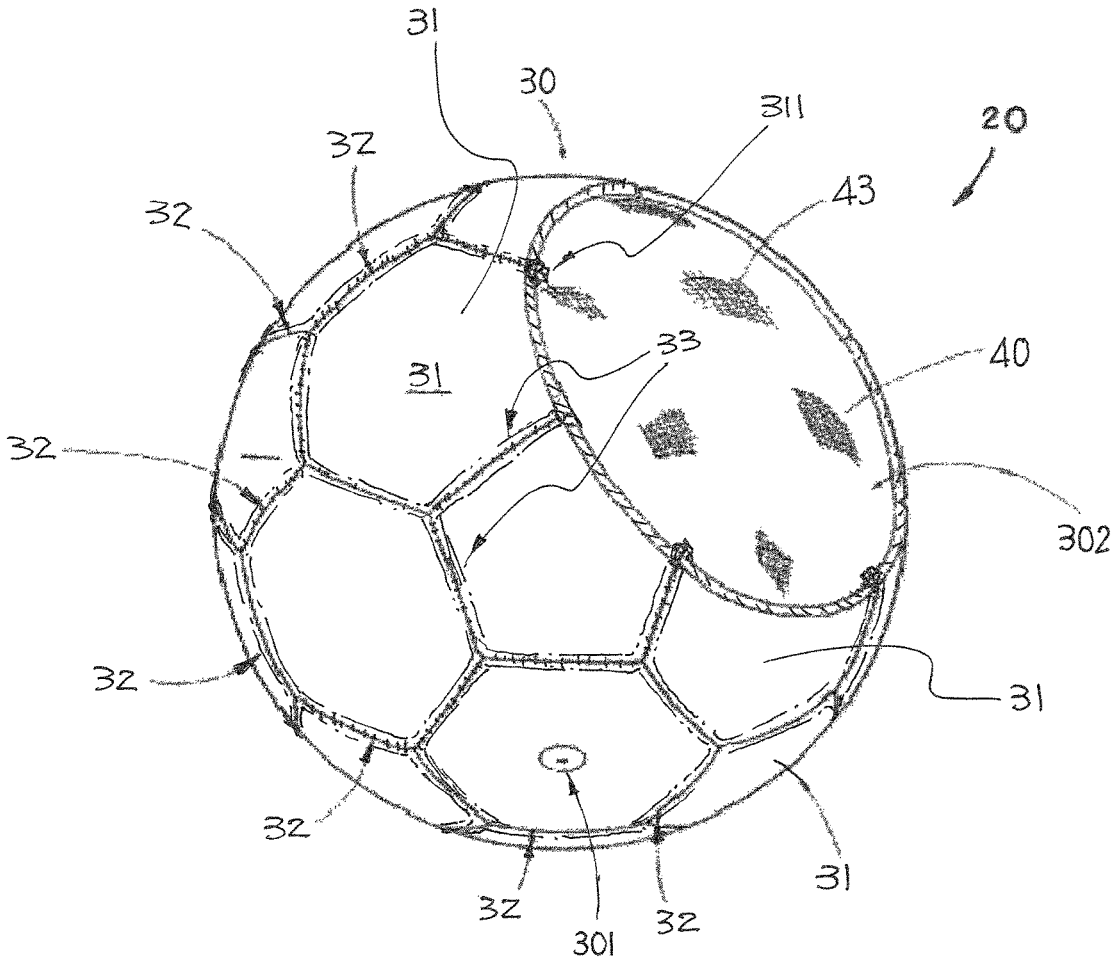
FIG. 3A is a partial sectional perspective view of a sportsball according to a preferred embodiment of the present invention, illustrating the construction web layer on the bladder ball of the ball carcass received in the ball cover.
Figure 3B:
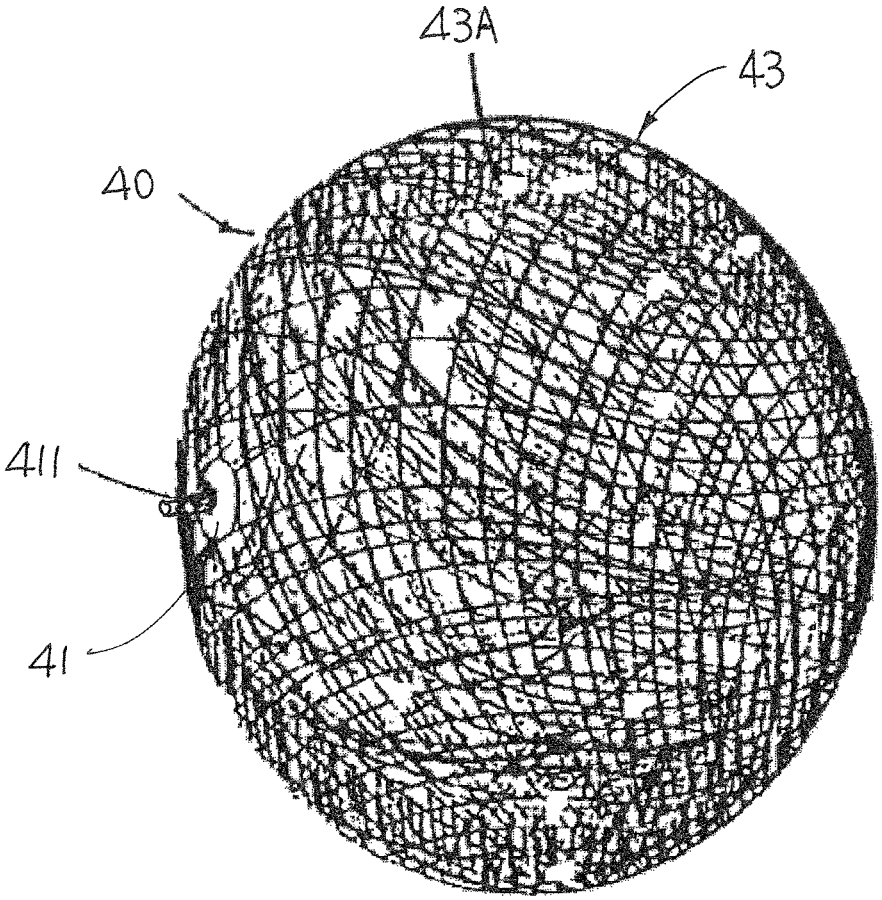
FIG. 3B is a perspective view of the ball carcass with the construction web layer of the sportsball according to the above preferred embodiment of the present invention.
Figure 4:
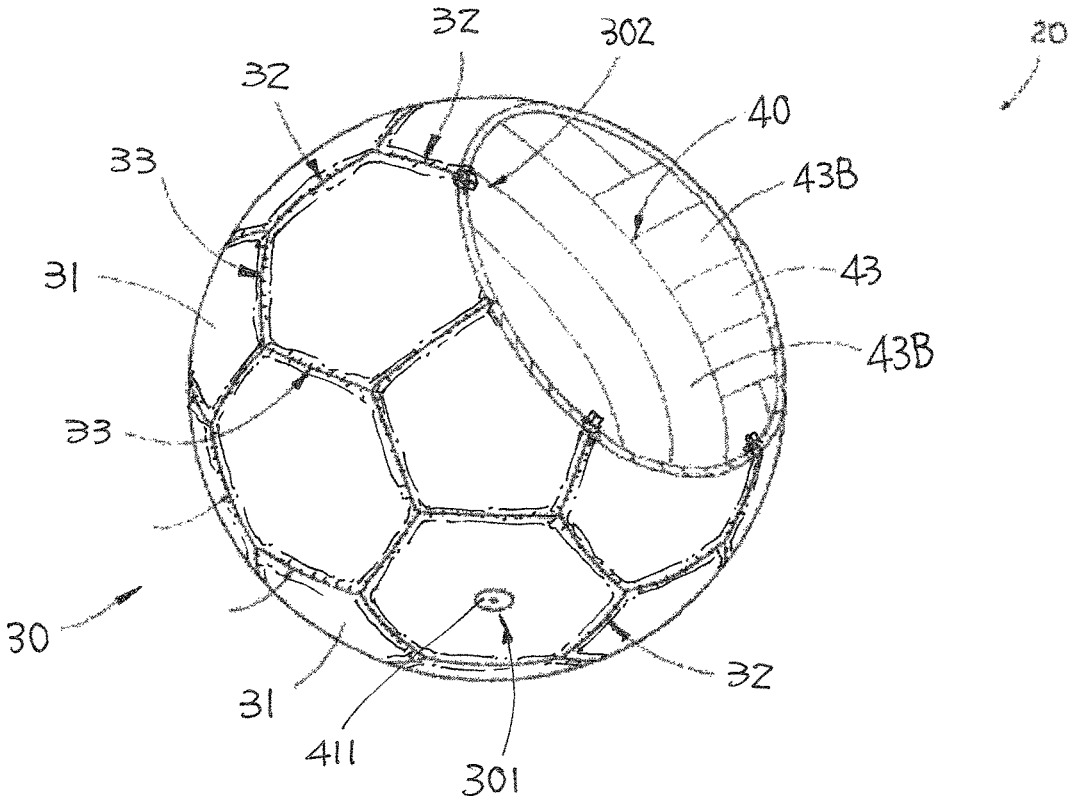
FIG. 4 is a partial sectional perspective view of a sportsball illustrating the construction ball pocket received in the ball cover according to an alternative mode of the ball carcass of the above preferred embodiment of the present invention.

As shown in FIGS. 3A and 3B, according to the preferred embodiment of the present invention, the construction layer 43 is a construction web layer 43A integrally provided on an outer surface of the bladder ball 41 such that the bladder ball 41 is entirely embraced by the construction web layer 43A. As shown in FIG. 4, an alternative mode of the ball carcass 40 is illustrated according to the above preferred embodiment of the present invention, wherein the construction layer 43 of the ball carcass 40 is a construction ball pocket 43B receiving the bladder ball 41 therein such that the bladder ball 41 is inflated with a predetermined amount of compression air for retaining the shape of the construction ball pocket 43B. The ball carcass 40 as shown in FIGS. 3A, 3B and 4 is known and taught in U.S. Pat. Nos. 5,772,545, 6,390,941, 6,656,067, 7,740,782 and 7,831,581, invented by the inventor of the present invention and incorporated herein by reference.

Figure 5A:
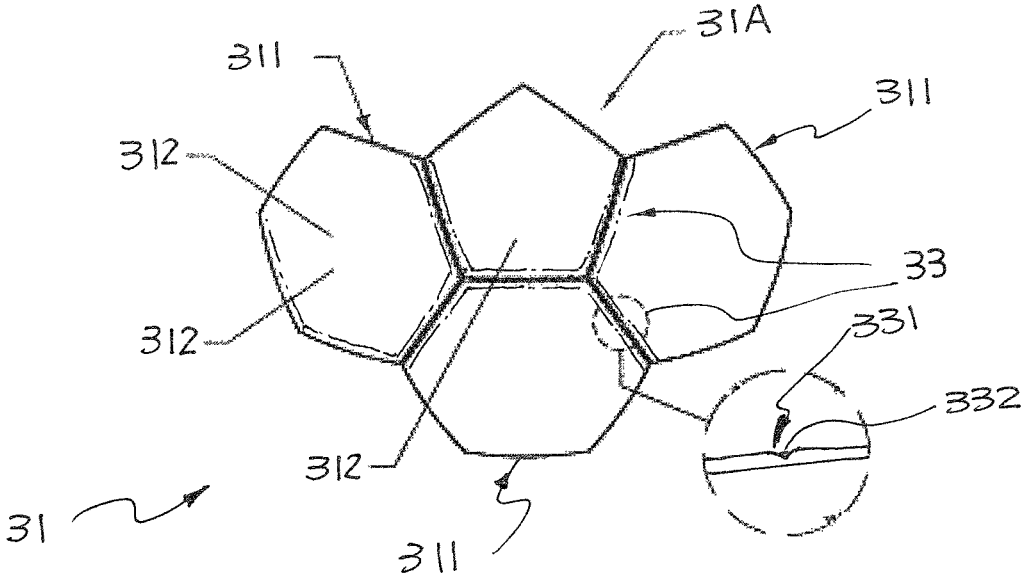
FIGS. 5A and 5B are schematic views illustrating two types of cover panel of the ball cover of the sportsball according to the above preferred embodiment of the present invention.
Figure 5B:
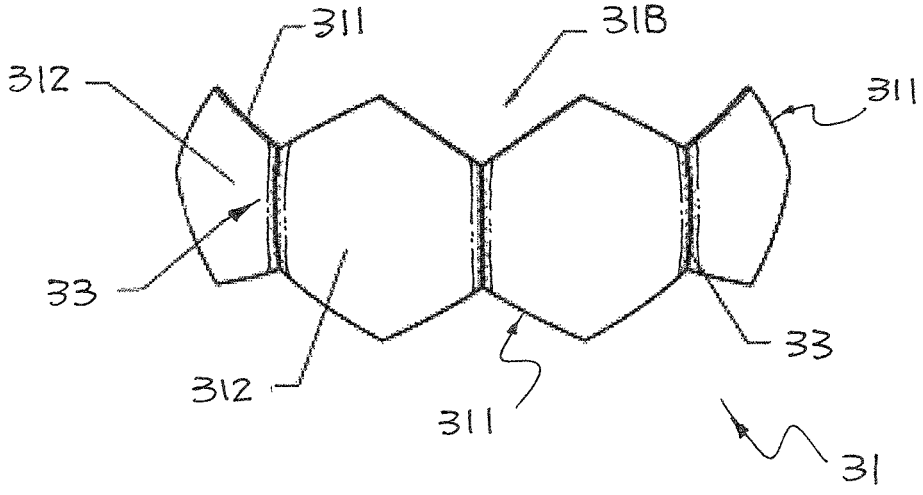

The ball cover 30, as shown in FIGS. 5A to 7, comprises two or more cover panels 31 connected in edge to edge manner with each other to form the ball cover 30 in ball shape. According to the preferred embodiment of the present invention, eight cover panels are provided, including four first type cover panels 31A as shown in FIG. 5A and four second type cover panels 31B as shown in FIG. 5B, each of the first type and second type cover panels 31A, 31B has a predetermined shape forming a plurality of connecting sides 311 along the periphery thereof, wherein each of the connecting sides 311 of the cover panels 31A, 31B is connected with one of the connecting sides 311 of another cover panel 31A or 31B to form a connecting seam 32. The ball cover 30 has the valve hole 301 and the vale stem 411 is extended from the ball carcass 40 to fix at the valve hole 301 for air inflation of the bladder ball 41 of the ball carcass 40. After the ball carcass 40 is inflated with compression air at a predetermined pressure through the valve stem 411, the ball cover 30 is supported by the ball carcass 40 enclosed therein for retaining the ball shape of the ball carcass 40 and the ball cover 40 is supported and retained by the construction layer 43 in a desired roundness. The bladder ball 41 is preferably made of rubber or other elastic material to be inflatable.

Figure 8:
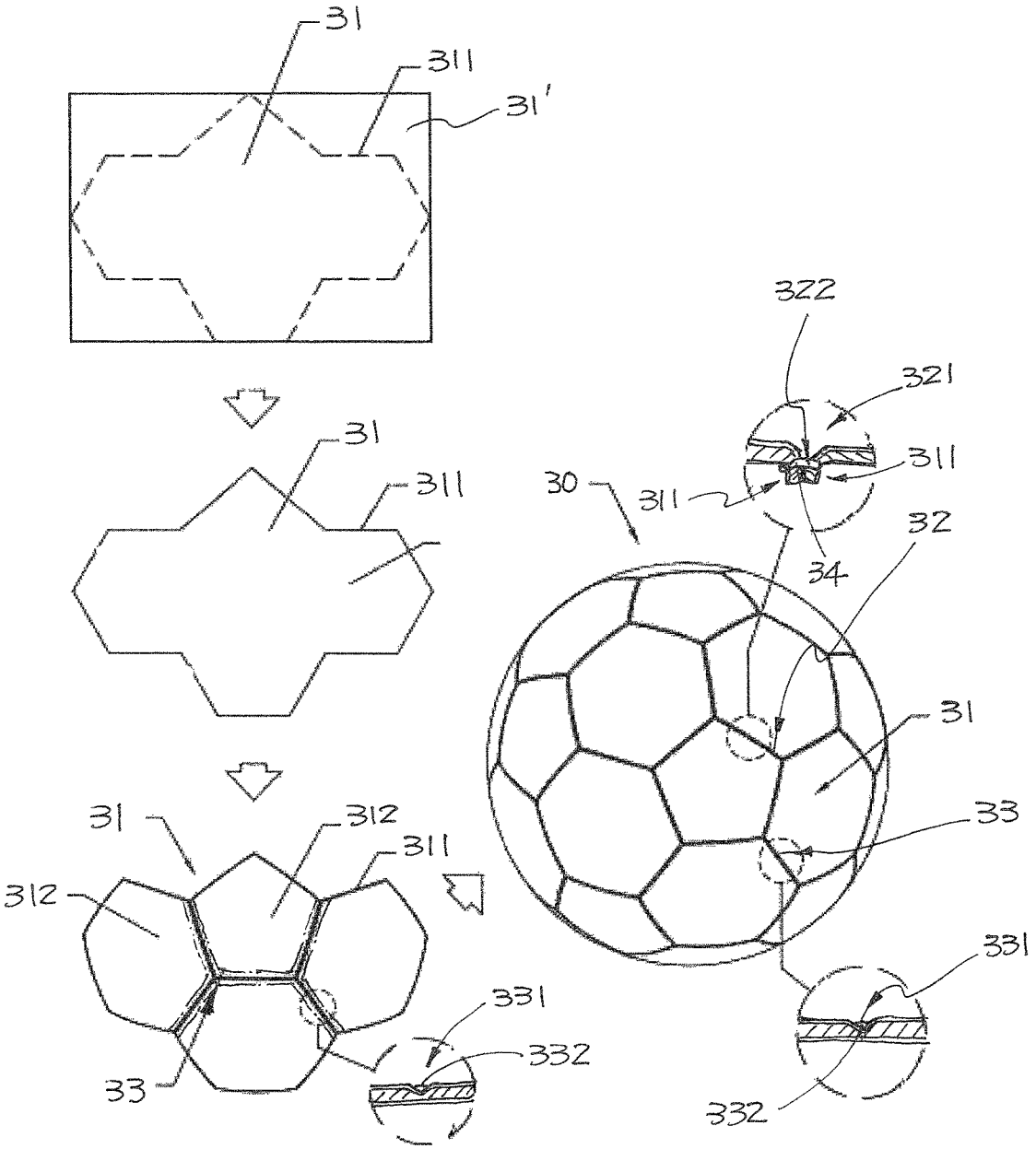
FIG. 8 is a block diagram of a method of manufacturing the sportsball according to the above preferred embodiment of the present invention.
Figure 11:
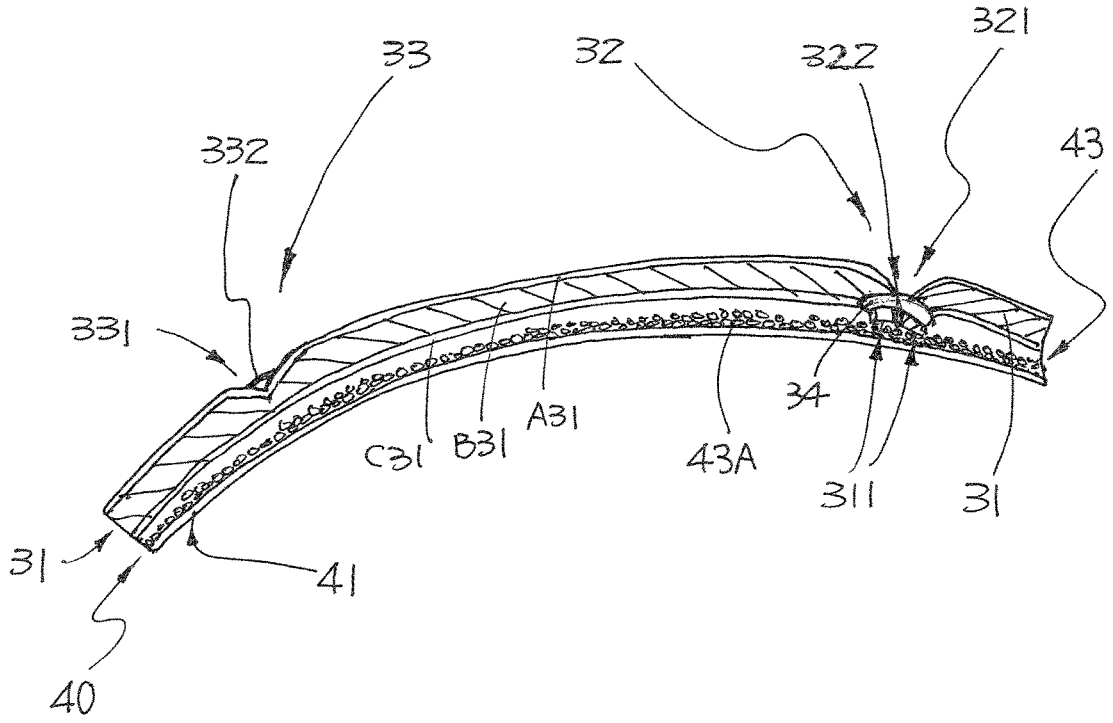
FIG. 11 is a partial enlarged sectional view of the ball carcass according to the above preferred embodiment of the present invention, illustrating the actual stitching seam between two cover panels sewn edge to edge and the virtual stitching seam molded on the cover panel of the carcass.

Referring to FIGS. 8 and 11, each of the cover panels 31, for example the first cover panel 31A, is cut to the predetermined shape from a piece of panel material 31' made of leather or synthetic leather such as polyurethane (PU) or polyvinyl chloride (PVC) which is composed of an outer coating layer A31, an intermediate layer B31 and an inner lining layer C31 to strengthen and support the intermediate layer B31. Before the cover panel 31 is connected with another cover panel 31, the first type cover panel 31A is molded to form one or more virtual stitching seams 33 to divide the first type cover panel 31A into four imitating panels 312, including one pentagon shape upper panel and three hexagonal shape lower, right and left panels, as shown in FIGS. 5A and 8. Alternatively, the second type cover panel 31B is molded to have a plurality of virtual stitching seams 33 dividing the second type cover panel 31B into four imitating panels 312, including two hexagonal shape middle panels and two pentagon shape outer panels.

As shown in FIGS. 3A, 3C, 6, 8, and 11 according to the preferred embodiment of the present invention, the connecting sides 311 of the cover panels 31 are sewed together in an edge to edge manner to form the connecting seams 32 therebetween, wherein the connecting seams 32 are an actual recessed stitching seams 32 each having an actual seam recess 321 and a plurality of actual stitching marks 322 formed by the stitching thread along a bottom of the actual seam recess 321, wherein stitching holes 3111 and gaps 3112 are formed between the two connecting sides 311 of two of the cover panels 31 and in between the stitching marks 322.

Figure 6:
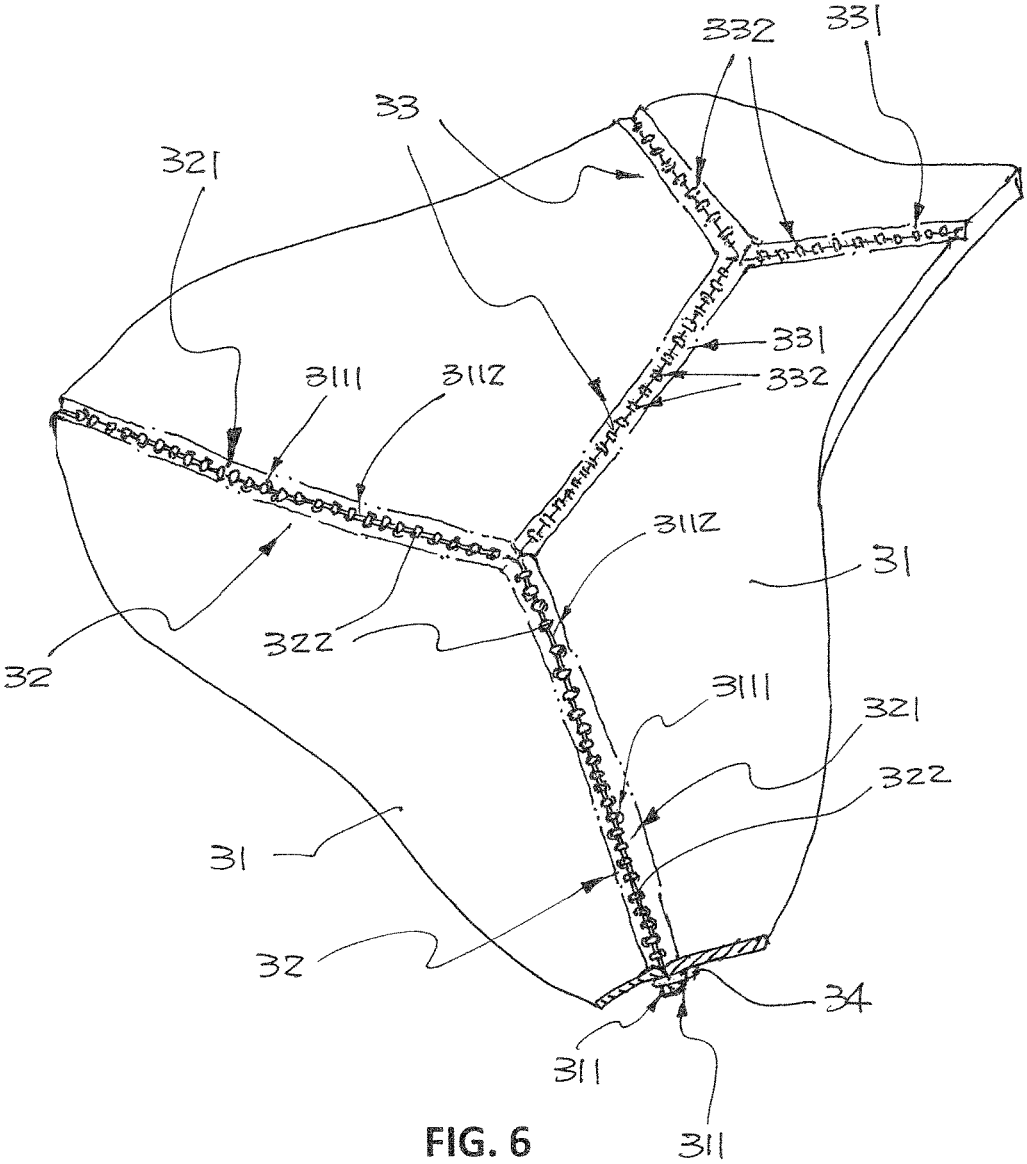
FIG. 6 is an enlarged partial sectional view illustrating the virtual stitching seams molded on the cover panel and the actual stitching seams formed between the cover panels of the sportsball according to the above preferred embodiment of the present invention.

Referring to FIGS. 3C, 5A, 5B, 6, 8, and 11, each of the virtual stitching seams 33 is molded by heat pressing mould to form a virtual seam recess 331 indented on the cover panel 31 and a plurality of virtual stitching marks 332 along a bottom of the virtual seam recess 331 imitating the actual stitching marks 322 of stitching threads 34 like an actual stitching seam 321 after connecting sides 311 of cover panels 31 being sewn edge to edge together like as shown in FIGS. 6, 8 and 11. In other words, no stitching hole or gap is formed in the virtual stitching seams 33 since the virtual stitching seams 33 are merely molded to form on the cover panels 31 while each of the cover panels 31 is remained in a whole piece.

Figure 7:
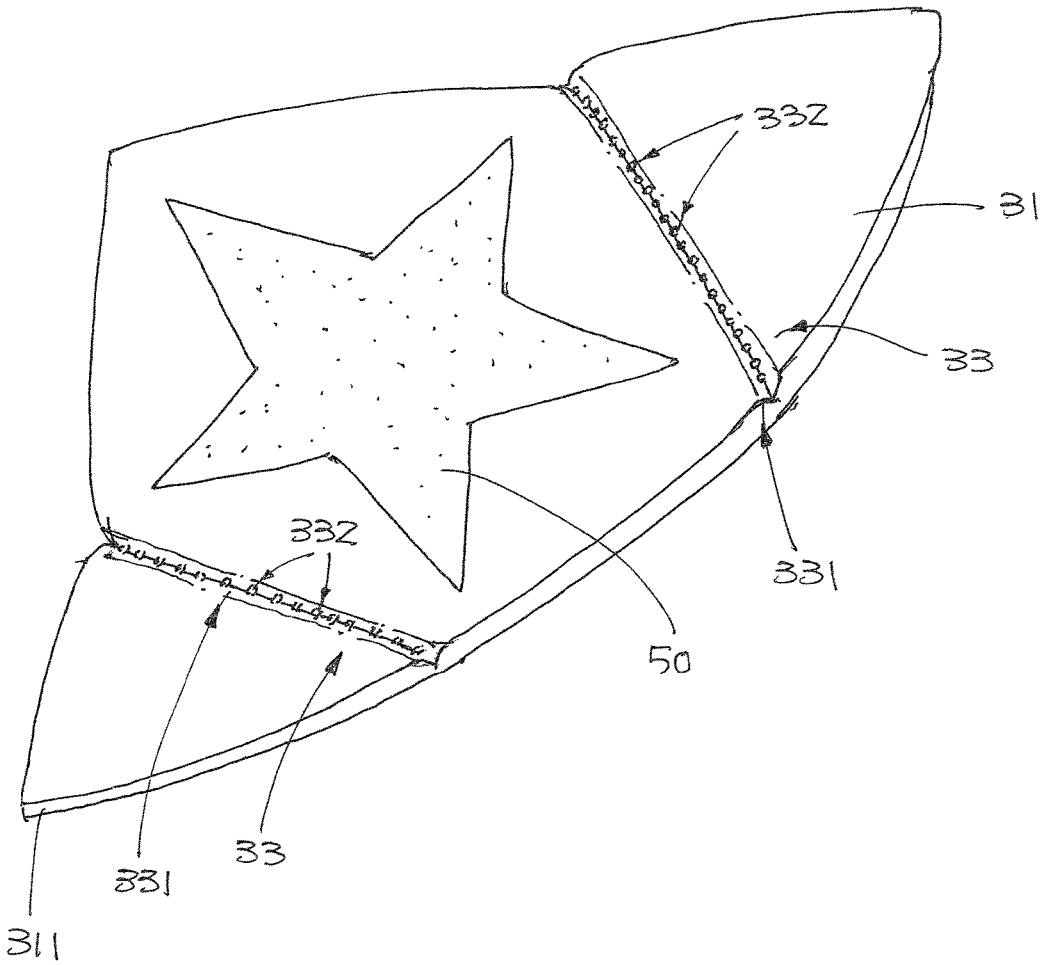
FIG. 7 is partial schematic view illustrating the virtual stitching seams and an aesthetic pattern printed on the cover panel of the sportsball according to an alternative mode of the above preferred embodiment.

It is worth mentioning that, as shown in FIGS. 7 and 8, before or after the cover panel 31 is cut in shape, the piece of panel material 31' can be firstly printed with any desired aesthetic pattern 50 thereon to contribute an overall pattern on the ball cover 30 after the cover panels 31 are connected together.

Figure 9:
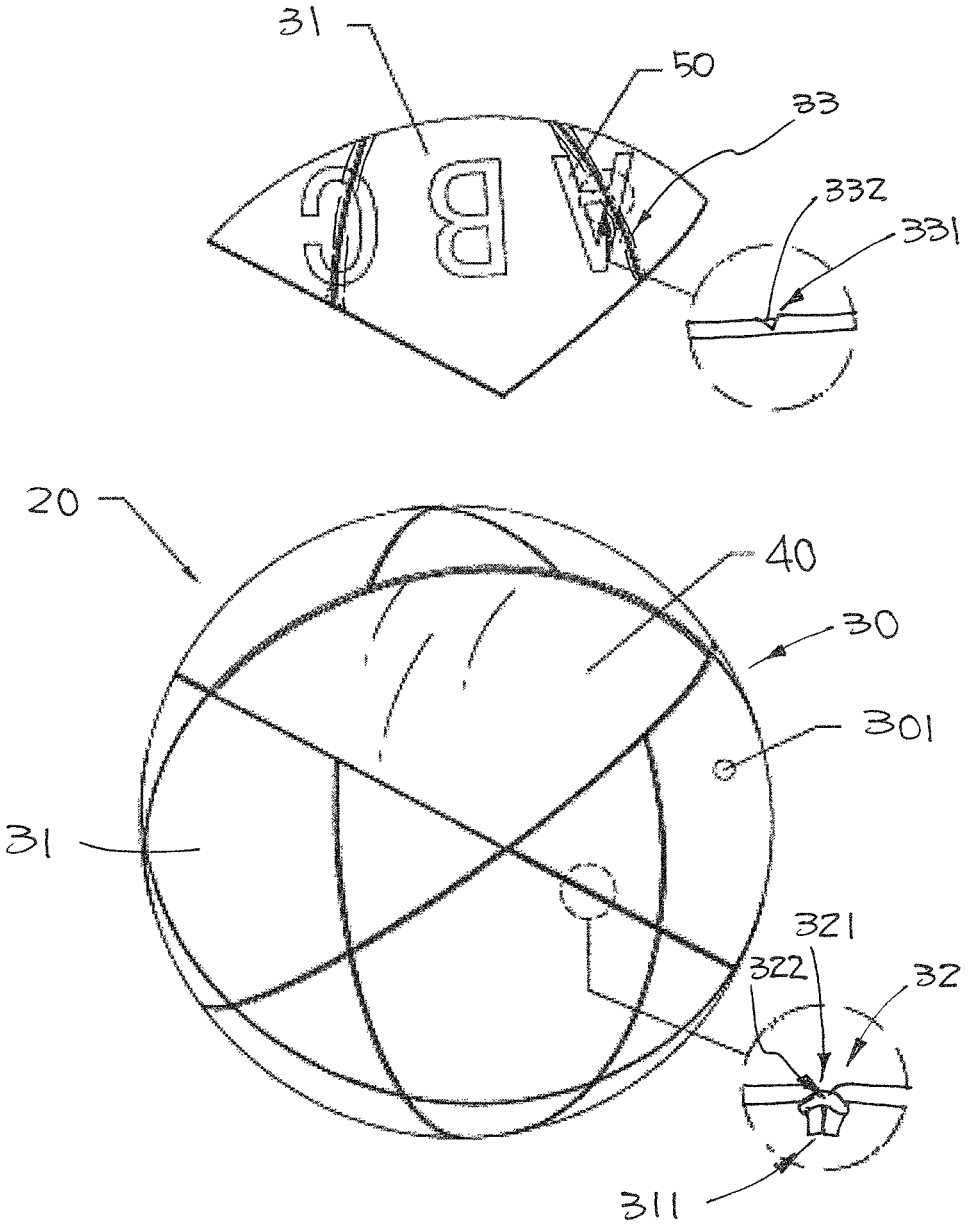
FIG. 9 is a partial exploded perspective view of a sportsball according to an alternative mode of the above preferred embodiment of the present invention.
Figure 10:
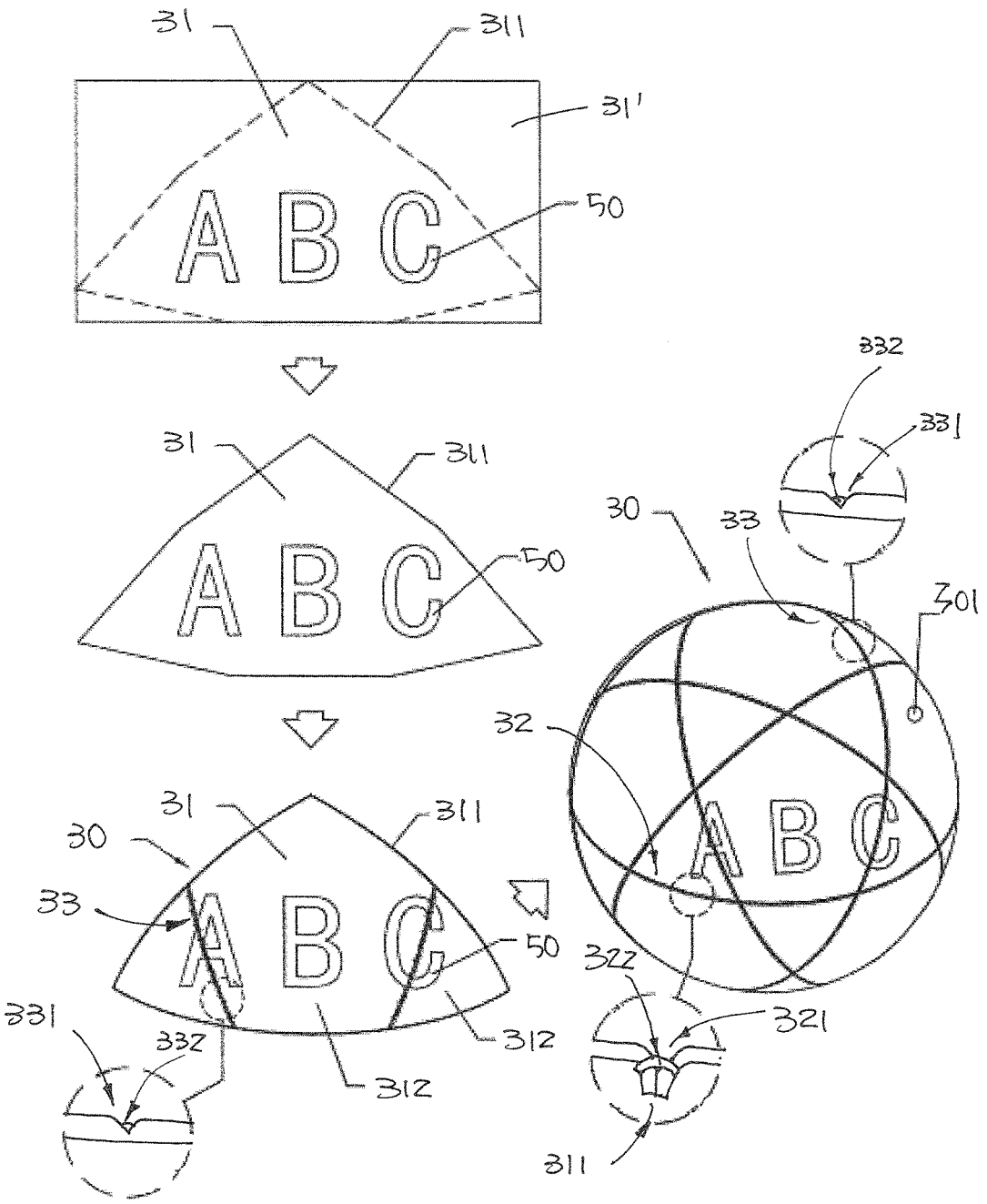
FIG. 10 is a block diagram of a method of manufacturing the sportsball according to the alternative mode of the above preferred embodiment of the present invention.

In addition, referring to FIGS. 7, 9 and 10, an alternative mode of the above preferred embodiment of the present invention is illustrated, wherein the cover panel 31 can be cut into other desired shape, other than pentagon or hexagonal shape, wherein all cover panels 31 have the same triangular shape as shown in FIGS. 9 and 10, each having two virtual stitching seams 33, and are sewn together in edge to edge manner to form multiple actual stitching seams 32 between the cover panels 31 and construct the ball cover 30 in ball shape.

Figure 3C:
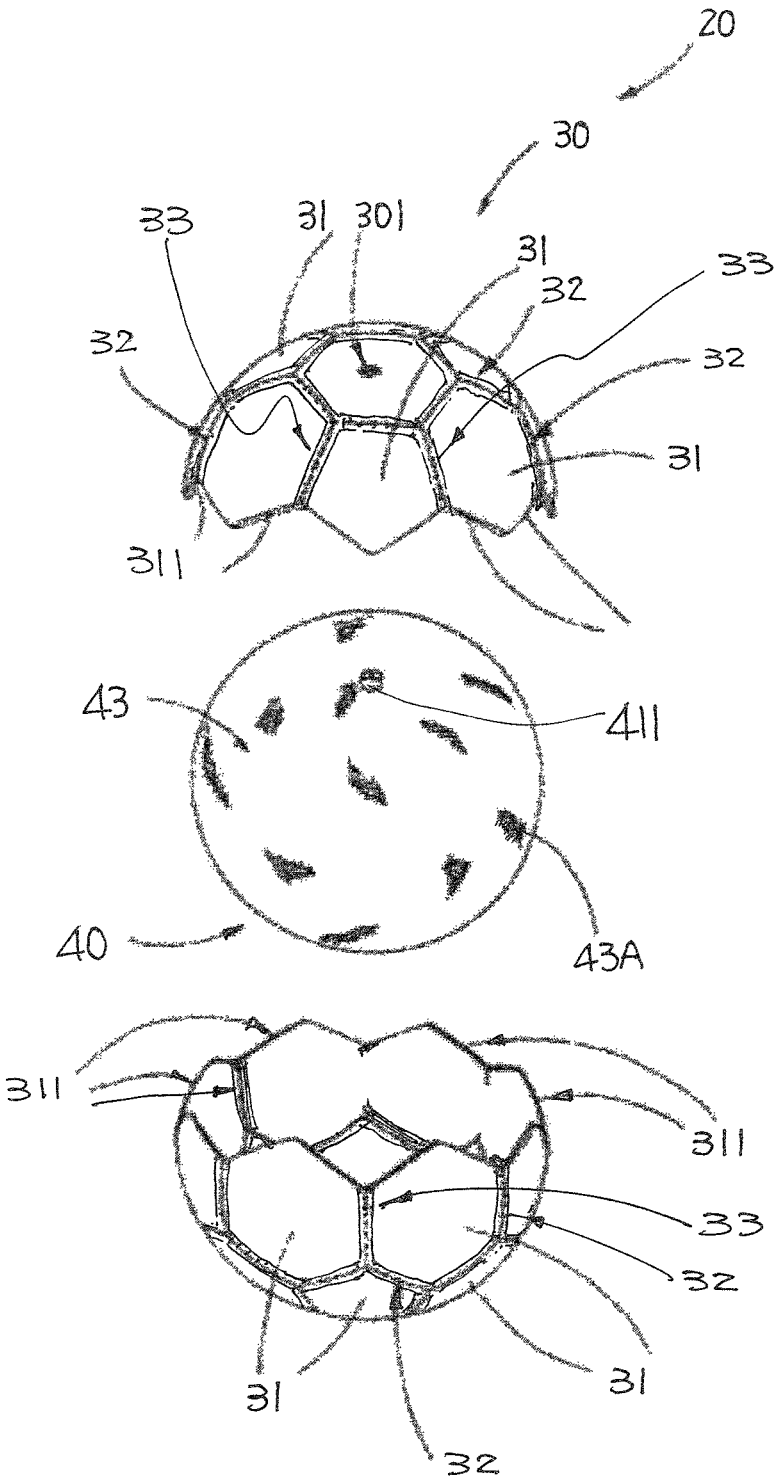
FIG. 3C is an exploded view of the sportsball according to the preferred embodiment of the present invention.

Referring to FIGS. 3C, 6 and 11, each of the connecting sides 311 of the cover panel 31 is overlappedly sewn with the respective connecting side 311 of another cover panel 31 by stitching threads 34 so as to connect the two cover panels 31 together at the connecting sides 311 sewn together. Then, the two cover panels 31 connected together are bent away from each other to match the radian of the ball carcass 40, wherein when the ball carcass 40 is inflated with air, the inflated ball carcass 40 applies a pressure outwardly holding up against the ball cover 30 while the stitching threads 34 holding the cover panels 31 together to retain and form the ball shape of the ball cover 30. Accordingly, the actual seam recess 321, generally in v-shape, is formed between the connecting edges of the two connecting cover panels 31, as shown in FIGS. 3C, 6 and 11, The actual seam recess 321 extends along the length of the connecting edges of the two connecting cover panels 31, wherein its width and depth depend on the materials and strength of the cover panel 31 and the stitching threads 34 and the holding force between the two connecting sides 311 of the two cover panels 31 by the stitching thread 34, and in other words, stitching gap 3112 is existed between the two connecting edges of the two connecting cover panels 31. Due to the propping pressure of the inflated ball carcass 40 against the ball cover 30, every two of the cover panels 31 sewn together have a trend of pulling away from each other so that each of the stitching threads 34 sewn therebetween is exposed in short transversal line form at a bottom of the actual seam recess 321 and between the respective stitching holes 3111 of the two connecting sides 311 of the two cover panels 31 to form the multiple actual stitching marks 322 along the actual seam recess 321, as shown in FIGS. 3C, 6 and 11.

As mentioned above, the virtual stitching seams 33 molded on the cover panels 31 are preferred to imitate the actual stitching seams 32. Accordingly, as shown in FIGS. 3C, 6, 8, and 11, the cover panel 33 after cut into desired shape is put between an upper mould and a lower mould to heat and mold by compressing the upper mould and lower mould together to form the virtual stitching seam 33, wherein one or more virtual seam recesses 331 are heated and pressed to indent on the cover panel 31 without actually breaking the cover panel 31 and each having the similar v-shape with width and depth like the actual seam recess 321 described above to divide the cover panel 31 into two or more panels 310, and that the multiple virtual stitching marks 332 imitating short transversal line form of the actual stitching marks 322 are also molded to form along the bottom of the virtual seam recess 331, so that no stitching hole or gap is formed in each of the virtual stitching seams 33 on the cover panels 31.

In view of above, after the sportsball 20 with the ball carcass 40 disposed inside the ball cover 30 is inflated with air under a predetermined pressure, the overall appearance of the sportsball 20, as shown in FIGS. 8 and 10, looks like there are multiple panels constructing the ball cover 30 with multiple connecting seams 32, 33, that are the actual stitching seams 32 and the virtual stitching seams 33, provided thereon that looks like the conventional sportsball as shown in FIGS. 1 and 2. However, the presence of the virtual stitching seams 33 of the present invention successfully not only reduces the total number of individual panels to be sewn together to form the ball cover as in the conventional sportsball, but also can avoid actual stitching holes and gaps in the actual stitching seams 32 as many as possible. That can provide better flying and rolling performance of the sportsball 20 in air and ground respectively.

Figure 12:
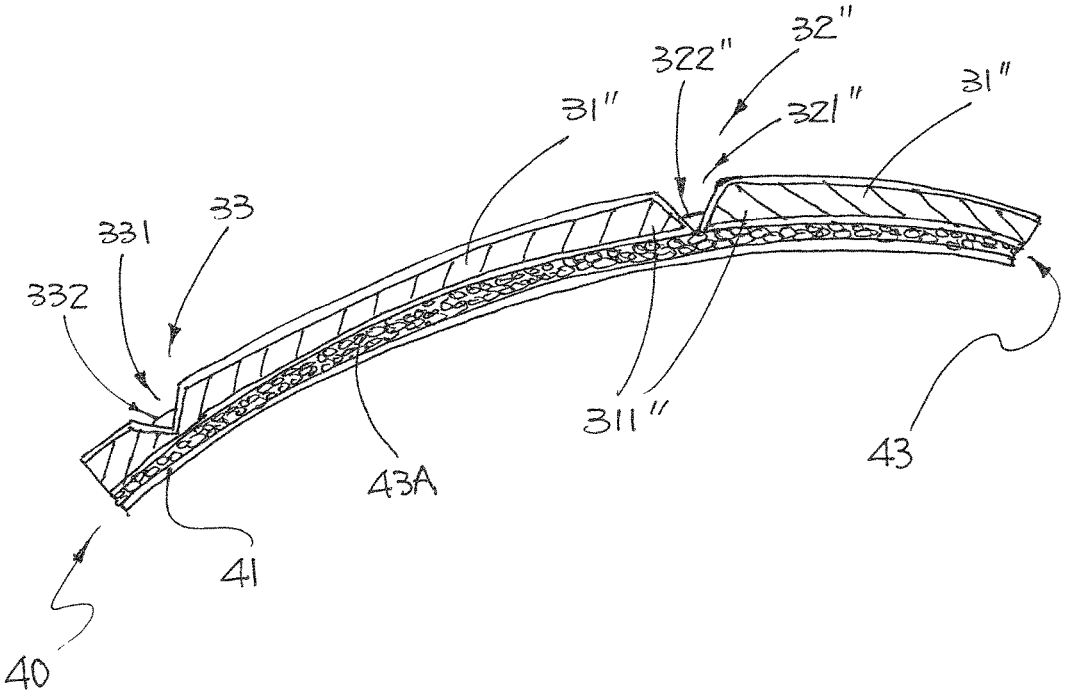
FIG. 12 is a partial enlarged sectional view of the ball carcass according to another alternative mode of the above preferred embodiment of the present invention, illustrating the virtual stitching seam molded on the cover panel and the virtual stitching marks molded at the connecting seam between two cover panels, wherein the ball panels are adhered on the ball carcass.

Referring to FIG. 12, an alternative mode of the above preferred embodiment of the present invention is illustrated, wherein the cover panels 31" are adhered on the outer surface the ball carcass 40 with the connecting sides 311" of the two adjacent cover panels 31" biased with each other in edge to edge manner, wherein the connecting edges between the cover panels 31" form the connecting seams which are molded to form the virtual recessed stitching seams 32", each of which forms a virtual seam recess 321" and multiple virtual stitching marks 322". Alternatively, the connecting sides 311" of the cover panels 31" can be inclined edges that gradually reduce their thickness to form slant surfaces. Therefore, the two adjacent connecting sides 311' of the two connecting cover panels 31' are biased with each other in edge to edge manner and the virtual seam recesses 321" in v-shape are form by the two connecting sides 311" of the two adjacent cover panels 31". Therefore, only the virtual stitching marks 322" are required to be molded to form in each of the virtual seam recesses 321" to form virtual recessed stitching seam 32".

According to the preferred embodiment of the present invention, the sportsball as disclosed above is able to be made by a manufacturing method comprising the steps of:

(a) preparing two or more of the cover panels 31, 31", each having the connecting sides 311, 311", and the ball carcass 40 comprising the inflatable bladder ball 41, the valve stem 411 mounted on the bladder ball 41, and the exterior construction layer 43 covering the bladder ball 41 to reinforce and strengthen the bladder ball 41 to support stress and impact force;

(b) forming the virtual stitching seams 33, 33" on the cover panels 31, 31", wherein each of the virtual stitching seams 33, 33" has the seam recess 331, 331" and the plurality of virtual stitching marks 332, 332" imitating the actual recessed stitching seam 32, 32" after connecting the connecting sides 311, 311" of the cover panels 31, 31" together in edge to edge manner; and (c) connecting the connecting sides 311, 311" of the cover panels 31, 31" in edge to edge manner forming the plurality of connecting seams 32, 32" to form the ball cover 30, 30" having the ball shape, the valve hole 301 and the receiving cavity 302 therein, wherein the ball carcass 40 is received in the receiving cavity 302 of the ball cover 30, 30" while the valve stem 411 is extended at the valve hole 301 of the ball cover 30, 30" for air inflation, wherein the ball cover 30, 30" is supported and retained by the construction layer 43 in a desired roundness after air inflation in the ball carcass 40.

According to the preferred embodiment of the present invention, the step (c) further comprises a step of sewing the connecting sides 311 of the cover panels 31 with each other to form the plurality of recessed stitching seams 32, each having the actual seam recess 321 and the plurality of actual stitching marks 322 along the bottom of the actual seam recess 321 intervally, as the virtual stitching seams 33 on the cover panels 30 are molded to look like the actual recessed stitching seams 32, each having the virtual seam recess 331 and the plurality of virtual stitching marks 332.

According to an alternative mode of the preferred embodiment of the present invention, the step (c) further comprises a step of adhering the cover panels 31" on the construction layer 43 of the ball carcass 40 to form the ball cover 30" enclosing the ball carcass 40, and the method further comprises a step (d) of forming the virtual recessed stitching seams 32" at the connecting seams of connecting edges between the cover panels 30" respectively by molding, wherein each of the virtual recessed stitching seams 32" are molded to also have the seam recess 321" and the virtual stitching marks 322" to look like the virtual stitching seams 33" molded on the cover panels 30".

In view of above, by forming the virtual stitching seams 32, 32" on the cover panels 31, 31" to divide the cover panels 31, 31" into imitating panels 310, the total number of cover panels 31, 31" can be reduced that not only facilitates the manufacturing process and reduces the manufacturing cost, but also minimizes the number of stitching holes and gaps of the actual stitching seams 32, so that the flying performance in air and rolling performance on ground of the sportsball 20 is improved. Moreover, complicate and colorful aesthetic pattern 50 can be pre-printed on the cover panels 31, 31" before connecting the cover panels 31, 31" to form the ball cover 30, 30". One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sportsball, comprising:

a carcass comprising an inflatable bladder ball and an exterior construction layer covering the bladder ball to reinforce and strengthen the bladder ball; and a ball cover comprising two or more cover panels having connecting sides connected with each other in edge to edge manner to form one or more connecting seams, wherein said ball cover is supported and retained by the construction layer in a desired roundness after air inflation, wherein at least one of said cover panels of said ball cover further provides one or more virtual stitching seams molded to form thereon, wherein said virtual stitching seams are pre-formed on at least one of said cover panels before said cover panels are connected with each other, each of which is adapted for imitating an actual stitching seam but having no stitching hole and gap, wherein each of said virtual stitching seams has a virtual seam recess and a plurality of virtual stitching marks formed along a bottom of said virtual seam recess for imitating actual stitching marks of stitching thread like the actual stitching seam formed at sides of panels being sewn edge to edge together, such that two different seam structures with the same appearance are formed at said ball cover that said virtual stitching seam is formed on said cover panel while said actual stitching seam is formed along a connection between said cover panels, wherein at least one of said virtual stitching seams is extended from said actual stitching seam.

2. The sportsball, as recited in claim 1, wherein said carcass comprises a valve stem mounted on said bladder ball and said ball cover has a valve hole where said valve stem extended thereat for air inflation.

3. The sportsball, as recited in claim 2, wherein said construction layer is a construction web layer integrally provided on an outer surface of said bladder ball such that said bladder ball is entirely embraced by said construction web layer.

4. The sportsball, as recited in claim 1, wherein said connecting sides of every two of said cover panels are sewn together by at least a stitching thread in edge to edge manner to form an actual recessed stitching seam having an actual seam recess and a plurality of actual stitching marks, wherein each of said virtual stitching seams is molded to look like said actual recessed stitching seam and have said virtual seam recess and said virtual stitching marks imitating said actual seam recess and said actual stitching marks of said actual recessed stitching seam.

5. The sportsball, as recited in claim 2, wherein said connecting sides of every two of said cover panels are sewn together by at least a stitching thread in edge to edge manner to form an actual recessed stitching seam having an actual seam recess and a plurality of actual stitching marks, wherein each of said virtual stitching seams is molded to look like said actual recessed stitching seam and have said virtual seam recess and said virtual stitching marks imitating said actual seam recess and said actual stitching marks of said actual recessed stitching seam.

6. The sportsball, as recited in claim 3, wherein said connecting sides of every two of said cover panels are sewn together by at least a stitching thread in edge to edge manner to form an actual recessed stitching seam having an actual seam recess and a plurality of actual stitching marks, wherein each of said virtual stitching seams is molded to look like said actual recessed stitching seam and have said virtual seam recess and said virtual stitching marks imitating said actual seam recess and said actual stitching marks of said actual recessed stitching seam.

7. The sportsball, as recited in claim 4, wherein said actual seam recess of each of said actual recessed stitching seams is an indented recess formed between connecting edges of said two cover panels sewn together and extended along a length of said connecting edges of said two cover panels, and that said actual stitching marks of each of said actual recessed stitching seams are portions of said stitching thread exposed between stitching holes of said connecting sides of said two cover panels respectively in short transversal line form at a bottom of said actual seam recess, wherein said virtual seam recess of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks are molded to imitate said short transversal line form of said actual stitching marks along a bottom of said virtual seam recess.

8. The sportsball, as recited in claim 5, wherein said actual seam recess of each of said actual recessed stitching seams is an indented recess formed between connecting edges of said two cover panels sewn together and extended along a length of said connecting edges of said two cover panels, and that said actual stitching marks of each of said actual recessed stitching seams are portions of said stitching thread exposed between stitching holes of said connecting sides of said two cover panels respectively in short transversal line form at a bottom of said actual seam recess, wherein said virtual seam recess of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks are molded to imitate said short transversal line form of said actual stitching marks along a bottom of said virtual seam recess.

9. The sportsball, as recited in claim 6, wherein said actual seam recess of each of said actual recessed stitching seams is an indented recess formed between connecting edges of said two cover panels sewn together and extended along a length of said connecting edges of said two cover panels, and that said actual stitching marks of each of said actual recessed stitching seams are portions of said stitching thread exposed between stitching holes of said connecting sides of said two cover panels respectively in short transversal line form at a bottom of said actual seam recess, wherein said virtual seam recess of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks are molded to imitate said short transversal line form of said actual stitching marks along a bottom of said virtual seam recess.

10. The sportsball, as recited in claim 1, wherein said virtual seam recesses of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks is molded in short transversal line form to imitate said actual stitching marks along a bottom of said virtual seam recess.

11. The sportsball, as recited in claim 2, wherein said virtual seam recesses of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks is molded in short transversal line form to imitate said actual stitching marks along a bottom of said virtual seam recess.

12. The sportsball, as recited in claim 3, wherein said virtual seam recesses of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks is molded in short transversal line form to imitate said actual stitching marks along a bottom of said virtual seam recess.

13. A manufacturing method of a sportsball, comprising the steps of:

(a) preparing two or more cover panels, each having connecting sides and a ball carcass comprising an inflatable bladder ball and an exterior construction layer covering said bladder ball to reinforce and strengthen said bladder ball;

(b) forming one or more virtual stitching seams on each of said cover panels, wherein each of said virtual stitching seams has a seam recess and a plurality of virtual stitching marks along a bottom of each of said virtual seam recesses for imitating actual stitching marks of stitching thread like an actual stitching seam formed at sides of panels being sewn edge to edge together;

(c) connecting said connecting sides of said cover panels in edge to edge manner forming a plurality of connecting seams to form a ball cover having a ball shape, wherein said connecting sides of said cover panels are sewed with each other to form a plurality of actual recessed stitching seams, wherein each of said virtual stitching seams imitates said actual stitching seam but having no stitching hole and gap, such that two different seam structures with the same appearance are formed at said ball cover that said virtual stitching seam is formed on said cover panel while said actual stitching seam is formed along a connection between said cover panels; and (d) receiving said ball carcass inside said ball cover, wherein said ball cover is supported and retained by said construction layer in a desired roundness after air inflation in said ball carcass.

14. The manufacturing method, as recited in claim 13, wherein each of said actual recessed stitching seams has an actual seam recess and a plurality of actual stitching marks along a bottom of said actual seam recess, wherein said virtual stitching seams on said cover panels are molded to look like said actual recessed stitching seams and to have said virtual seam recess and said plurality of virtual stitching marks.

15. The manufacturing method, as recited in claim 13, wherein said carcass comprises a valve stem mounted on said bladder ball and said ball cover has a valve hole where said valve stem extended thereat for air inflation.

16. The manufacturing method, as recited in claim 14, wherein said carcass comprises a valve stem mounted on said bladder ball and said ball cover has a valve hole where said valve stem extended thereat for air inflation.

17. The manufacturing method, as recited in claim 15, wherein said construction layer is a construction web layer integrally provided on an outer surface of said bladder ball such that said bladder ball is entirely embraced by said construction web layer.

18. The manufacturing method, as recited in claim 16, wherein said construction layer is a construction web layer integrally provided on an outer surface of said bladder ball such that said bladder ball is entirely embraced by said construction web layer.

19. The manufacturing method, as recited in claim 14, wherein said connecting sides of every two of said cover panels are sewn together by at least a stitching thread in edge to edge manner to form said actual recessed stitching seams having said actual seam recess and said plurality of actual stitching marks, wherein each of said virtual stitching seams is molded to look like said actual recessed stitching seam and have said virtual seam recess and said virtual stitching marks imitating said actual seam recess and said actual stitching marks of said actual recessed stitching seam.

20. The manufacturing method, as recited in claim 18, wherein said connecting sides of every two of said cover panels are sewn together by at least a stitching thread in edge to edge manner to form said actual recessed stitching seams having said actual seam recess and said plurality of actual stitching marks, wherein each of said virtual stitching seams is molded to look like said actual recessed stitching seam and have said virtual seam recess and said virtual stitching marks imitating said actual seam recess and said actual stitching marks of said actual recessed stitching seam.

21. The manufacturing method, as recited in claim 19, wherein said actual seam recess of each of said actual recessed stitching seams is an indented recess formed between connecting edges of said two cover panels sewn together and extended along a length of said connecting edges of said two cover panels, and that said actual stitching marks of each of said actual recessed stitching seams are portions of said stitching thread exposed between stitching holes of said connecting sides of said two cover panels respectively in short transversal line form at a bottom of said actual seam recess, wherein said virtual seam recess of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks is molded to imitate said short transversal line form of said actual stitching marks along a bottom of said virtual seam recess.

22. The manufacturing method, as recited in claim 20, wherein said actual seam recess of each of said actual recessed stitching seams is an indented recess formed between connecting edges of said two cover panels sewn together and extended along a length of said connecting edges of said two cover panels, and that said actual stitching marks of each of said actual recessed stitching seams are portions of said stitching thread exposed between stitching holes of said connecting sides of said two cover panels respectively in short transversal line form at a bottom of said actual seam recess, wherein said virtual seam recess of each of said virtual stitching seams is an indented recess molded on said cover panel and extended along said respective virtual stitching seam with width and depth like said actual seam recess of said actual stitching seam to divide said cover panel into two or more panels, wherein said virtual stitching marks is molded to imitate said short transversal line form of said actual stitching marks along a bottom of said virtual seam recess.

* * * * *